United States Patent [19]

Schoenfeld

[11] Patent Number: 4,567,961

[45] Date of Patent: Feb. 4, 1986

[54] SAFETY DEVICE FOR BOATERS

[76] Inventor: Gerald R. Schoenfeld, 426 Vine St., Clyde, Ohio 43410

[21] Appl. No.: 535,599

[22] Filed: Sep. 26, 1983

[51] Int. Cl.[4] ..... B63C 9/00

[52] U.S. Cl. ..... 182/3; 441/108; 441/112; 441/84

[58] Field of Search ..... 182/3–5, 182/48; 441/108, 112, 84, 92–94; 244/151 B, 146

[56] References Cited

U.S. PATENT DOCUMENTS

| | | | |
|---|---|---|---|
| 2,368,558 | 1/1945 | Maloney | 441/84 |
| 2,675,143 | 4/1954 | Seemann | 441/93 |
| 2,725,853 | 12/1955 | Nordheim | 119/124 |
| 2,878,981 | 3/1959 | Guido | 227/49 |
| 3,088,438 | 5/1963 | Oliphant | 119/96 |
| 3,317,936 | 5/1967 | Johnson | 441/84 |
| 4,011,614 | 3/1977 | Bell | 441/108 |
| 4,140,205 | 2/1979 | Matson | 182/3 |
| 4,313,236 | 2/1982 | Tupper | 182/3 |

FOREIGN PATENT DOCUMENTS

| | | | |
|---|---|---|---|
| 2341619 | 2/1975 | Fed. Rep. of Germany | 182/3 |
| 3150489 | 6/1983 | Fed. Rep. of Germany | 182/3 |
| 188116 | 3/1964 | Sweden | 182/3 |
| 2077198 | 12/1981 | United Kingdom | 441/84 |
| 2081660 | 2/1982 | United Kingdom | 182/3 |

*Primary Examiner*—Reinaldo P. Machado
*Assistant Examiner*—Alvin Chin-Shue
*Attorney, Agent, or Firm*—Richard C. Darr

[57] ABSTRACT

A safety device for boaters wherein a tethering line is secured at one end to the boat occupant. The line is wound upon a self-retracting reel affixed to the craft which permits the occupant to withdraw line and move about the boat with relative freedom while assuring that he does not become separate from the boat if he should accidentally fall overboard. The line is of such maximum length that in that event it will enable the boater to pull himself back to the boat. The reel may be of the inertial type which will permit withdrawal of line at a normal speed but which will lock and prevent further withdrawal in the event of sudden lurching movement. The line may also be connected to an inflatable life belt or harness worn by the occupant which automatically inflates upon manual disengagement from the tethering line.

4 Claims, 3 Drawing Figures

SAFETY DEVICE FOR BOATERS

BACKGROUND OF THE INVENTION

1. Field of the Invention

This invention generally pertains to safety devices for boaters, and more particularly to tethering devices for preventing boat occcupants from being accidentally thrown overboard and separated from the craft.

2. Description of the Prior Art

Great emphasis has been placed upon boating safety in recent years, both in development of new safety devices and in educating the boating public to utilize such devices. Despite the best efforts of boating safety experts, many lives continue to be lost each year in boating incidents which are preventable. Thus, many of the lives could be saved if boat occupants would utilize existing safety devices. For example, the wearing of a conventional life jacket will in most cases buoy up a wearer who falls into the water until he can be rescued. Such jackets do not, however, prevent the wearer from becoming separated from the boat in the event he falls into the water, and this can be a serious problem, particularly where the individual is alone in the boat. More importantly, conventional life jackets are cumbersome and restrictive in nature, and thus boaters tend to not wear them even though they are present in the boat.

In order to prevent a boat occupant from becoming separated from the boat in the event he falls overboard. U.S. Pat. No. 2,878,981 disloses a life chain having one end anchored to the boat and the other extending around the waist of the user. A gathering or retracting mechanism is affixed to the chain to eliminate excess slack between the user and the anchor point, and thus prevent the loose chain from becoming entangled in the bottom of the boat. While such a device is good in theory, it is likewise cumbersome and restrictive, and has not gained acceptance by boaters. To be effective, safety devices must not only function for their intended purpose, but must also be sufficiently comfortable and convenient as to not deter people from using them.

SUMMARY OF THE INVENTION

To that end, the present invention includes a light weight belt or tether line adapted to be secured at one end to a boat occupant. The line is wound upon a self-retracting reel conveniently affixed to the boat structure so that is can be easily withdrawn from the reel whereby the wearer can move about the boat with relative ease. The reel maintains a slight tension on the line so that any slack is avoided, thereby minimizing the possibility of entanglement while permitting freedom of movement about the vessel. The self-retracting reel may be of an inertial type which will permit the line to be withdrawn at a speed equivalent to normal movement of the user about the boat, but which will lock in the event of a sudden lurching movement and prevent further withdrawal of the line. The means by which the line is secured to the user may include a self-inflating flotation means which will automatically inflate upon activation of a safety release mechanism actuated by the wearer to disengage himself from the line in the event it becomes necessary to do so. The flotation means may, for example, be of the belt type worn around the waist, or of the harness type further incorporating straps over the shoulders of the wearer.

It is therefore a primary object of the invention to provide a safety device for boaters which is highly effective in preventing loss of human life in boating accidents.

Another object of the invention is to provide a safety device for boaters which is not unduly restrictive in nature so that it will be readily acceptable to potential users.

Another object of the invention is to provide a device which will prevent a boater from becoming separated from the boat should he accidentally fall overboard.

Still another object is to provide such a safety device which will enable a user who falls overboard to pull himself back to the boat.

Other objects and advantages will become more apparent during the course of the following description when taken in connection with the accompanying drawings.

BRIEF DESCRIPTION OF THE DRAWINGS

In the drawings, wherein like numerals refer to like parts throughout.

DESCRIPTION OF THE PREFERRED EMBODIMENT

Figure 1:
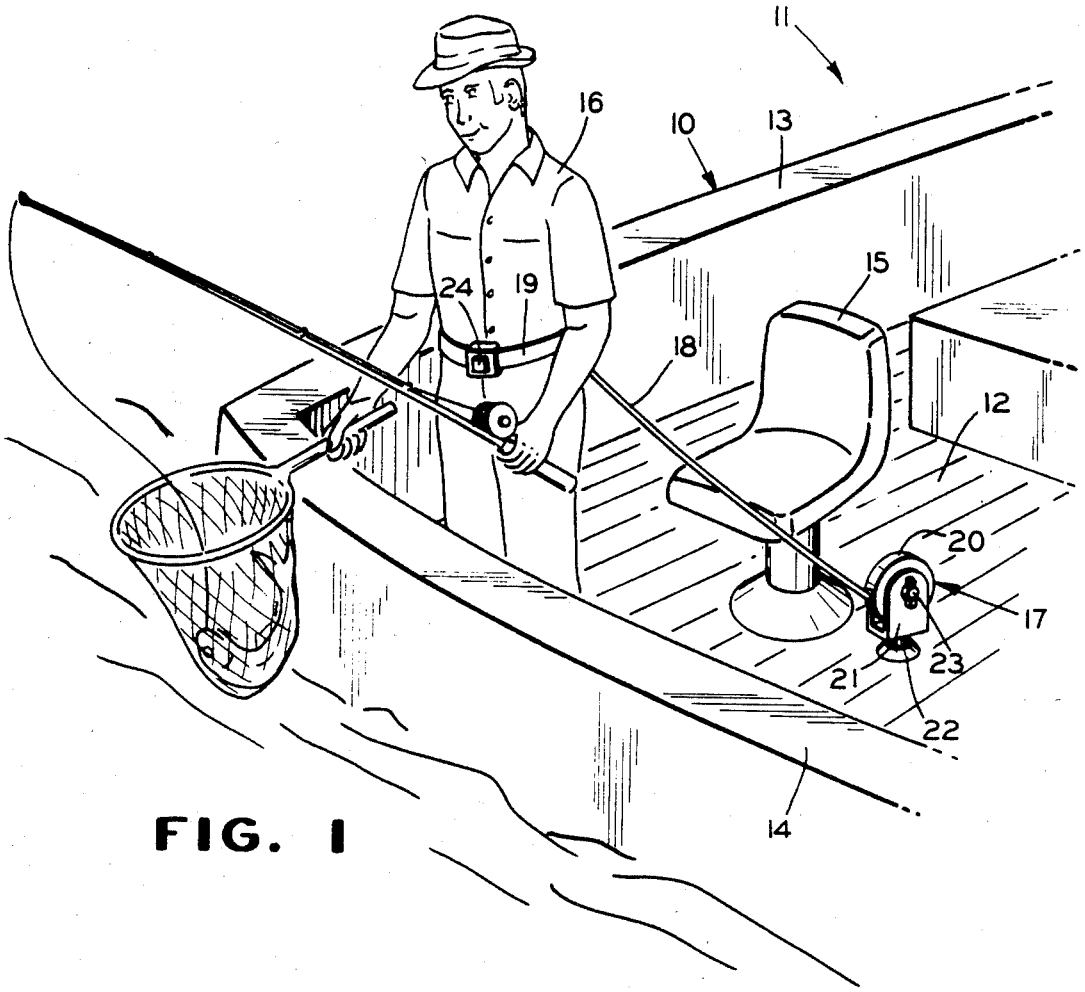
FIG. 1 is a perspective view showing the invention as used by a boat occupant engaged in fishing at the rear of a boat.

Referring now to the drawings, there is shown generally in FIG. 1 the aft section 10 of conventional boat 11 including a deck 12 with sides 13 and a rear transom 14 extending upwardly therefrom. Attached to the deck is a chair 15 for use as desired by a boat occupant 16 such as the fisherman standing at the rear of the vessel. It will be understood that while an individual chair, which may be mounted so as to swivel about its base has been shown for purposes of illustration, the invention may likewise be employed in conjunction with other seating arrangements such as bench seats and moveable chairs, or with no seats.

A self-retracting reel mechanism, shown generally at 17, is affixed to the deck 12 for permitting withdrawal therefrom of a tethering line 18 suitably detachably affixed to a belt 19 worn by the occupant 16. As hereinbefore mentioned, the reel mechanism 17 is of a commercially available type which permits easy withdrawal of the tethering line 18 as necessary for the occupant to move about the boat while maintaining a slight tension on the line to insure that it retracts and does not become slack so that entanglement may occur. The tethering line may be of any suitable material and of either the flat ribbon or cylindrical type.

The reel mechanism 17 may include a reel case 20 containing the line retracting and winding mechanism, mounted within a yoke 21 carried by a swivel base 22 fastened to the deck 12 or otherwise securely affixed to an appropriate area of the boat. A lever 23 is provided on the device for manually locking the reel to prevent withdrawal of the tethering line at desired times such as when the boat occupant is seated upon chair 15.

The belt 19 to which the tethering line 18 is affixed may be of any suitable type which is comfortable to the wearer, and preferably includes a conventional swivel unit (not shown) at the rear by means of which the line is connected. The belt also preferably includes a safety release buckle 24 such as that conventionally emloyed with automobile safety belts whereby the size of the belt can be adjusted to fit the wearer and the belt can be quickly removed should it be necessary to do so.

Depending upon the size and configuration of the vessel and the use for which it is intended, the tethering line 18 may, of course, be of such length that it is impossible for the boat occupant to be thrown from the vessel while connected thereto. Thus, the tethering line may have a maximum length such that when fully extended it allows the occupant only to approach the side 13 or rear transom 14 nearest the point at which the reel mechanism 17 is secured to the boat. In that event the line would not permit the occupant to slip overboard at any point on the boat. Where it is necessary or desirable for the occupant to move to more distant areas on the boat, thus requiring a longer tethering line which would extend beyond the boat at some points, it is contemplated that an inertial type reel or retracting mechanism, as commonly employed in the automotive industry, may be utilized in the self-retracting reel mechanism 17. Retractors of this type are shown generally in U.S. Pat. Nos. 4,201,281 and 4,201,282, for example. Such a reel permits the wearer to withdraw line and move about the deck at normal speeds, but in the event of sudden movement as would be caused by lurching of the boat, the reel locks and prevents further withdrawal of the tethering line, so long as tension is maintained in it. This embodiment has a further advantage in that should the user nevertheless fall overboard, a quick tug on the line will lock the reel mechanism and allow him to pull himself back to the boat without first withdrawing all of the line from the reel.

On infrequent occasions, boat occupants are thrown into the water due to the sinking or capsizing of the boat and thus are not able to return to the boat. Thus, in accordance with the embodiment of FIG. 2, a self-inflating flotation device 25 adapted to be worn by the boat occupant is the means by which the occupant is connected to the tethering line 18. It is highly desirable that the flotation device not be cumbersome and uncomfortable during normal usage, so that it will routinely be worn by boat occupants. To that end the device includes a waist encircling belt 26 fastened at the front by a buckle 27 and to which is attached a plurality of pouches 28, each containing a normally deflated and stowed flotation bay 29. The flotation bags are connected to a cylinder 30 of compressed gas such as carbon dioxide within the belt in a conventional manner. An emergency handle 30' is provided at the front of the device 25 which, when pulled, simultaneously inflates the flotation bags 29 and disengages the flotation device 25 from the tethering line 28. Thus, in those instances where it may become necessary for the boat occupant to separate himself from the boat, it is only necessary for him to pull the emergency handle 30' to disengage the tethering line and inflate the flotation bags which will assist him in staying afloat until rescued.

Figure 3:
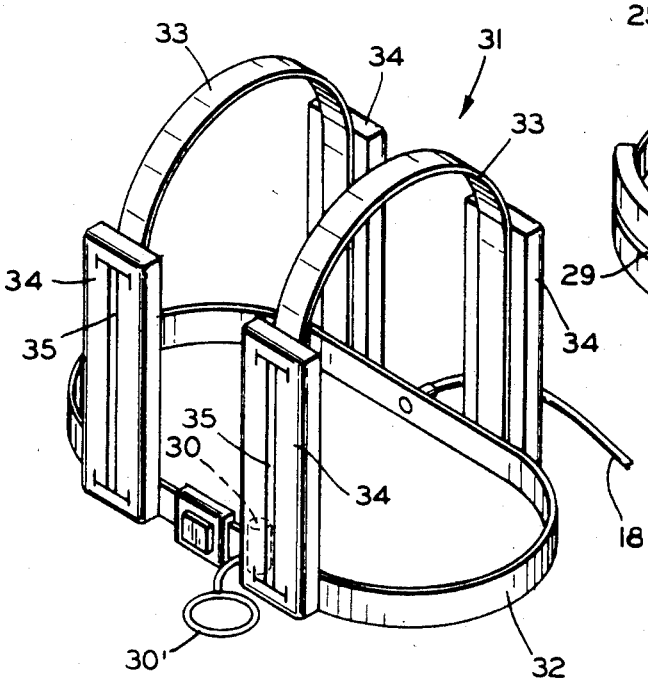
FIG. 3 is a perspective view of a self-inflating flotation harness device for securing the tether line to the user in still another embodiment of the invention.
Figure 2:
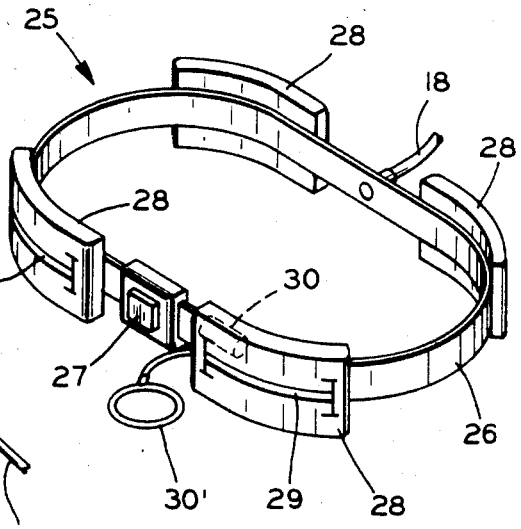
FIG. 2 is a perspective view of a self-inflating flotation belt device for securing the tether line to the user in an alternate embodiment of the invention.

The embodiment of FIG. 3 functions in the same manner as that of FIG. 2 while employing a flotation device of a slightly different construction providing somewhat greater flotation capability. Thus, the boat occupant 16 is provided with a self-inflating flotation harness 31 having a waist encircling belt 32 and shoulder straps 33. Affixed to the shoulder straps are pouches 34 containing normally deflated and stowed flotation bags 35. As with the prior embodiment, an emergency handle 30' is provided at the front of the harness 31 which, when pulled, simultaneouly inflates the flotation bags 35 and disengages the harness from the tethering line 18.

It is believed apparent there is provided in accordance with the invention a safety device for boaters which is relatively simple and inexpensive, and which is capable of saving a great many lives when utilized. Furthermore, the invention is not unduly cumbersome so that it will be accepted and used by boaters whereas many heretofore proposed safety devices have been ignored.

It is to be understood that the forms of the invention herewith shown and described are to be taken as illustrative embodiments only of the same, and that various changes in the shape, size and arrangement of parts may be resorted to without departing from the spirit of the invention.

I claim:

1. A safety device for a boat occupant, comprising a tethering line wound upon a self-retracting reel, means affixing said reel to the boat structure, means for manually locking said self-retracting reel to prevent further withdrawal of said tethering line at selected positions, means securing the free end of said tethering line to said boat occupant including a belt worn around the waist of said occupant and means connecting said line to said belt, said self-retracting reel being biased to rewind and maintain tension on said tethering line so as to prevent accumulation of slack line between said reel and said occupant while permitting said occupant to move about said boat with relative freedom, and said self-retracting reel including inertial means permitting said tether line to be withdrawn at a speed permitting normal movement by said occupant about said boat and locking in response to sudden more rapid movement to prevent further withdrawal of said line, said means securing the free end of said tethering line to said boat occupant comprising inflatable flotation means worn by said occupant, said flotation means comprising a waist encircling belt, said tethering line being releasably connected to said belt, a normally deflated flotation bag carried by said belt, a pouch affixed to said belt within which said normally deflated flotation bag is stowed, compressed gas container means, and means for releasing the compressed gas from said container means to inflate said flotation bag, said means for releasing the compressed gas comprising an emergency handle adapted to be activated by said occupant for simultaneously inflating said flotation bag and disconnecting said tethering line from said belt.

2. A safety device for a boat occupant, comprising a tethering line would upon a self-retracting reel, means affixing said reel to the boat structure, means for manually locking said self-retracting reel to prevent further withdrawal of said tethering line at selected positions, means securing the free end of said tethering line to said boat occupant including a belt worn around the waist of said occupant and means connecting said line to said belt, said self-retracting reel being biased to rewind and maintain tension on said tethering line so as to prevent accumulation of slack line between said reel and said occupant while permitting said occupant to move about said boat with relative freedom, and said self-retracting reel including inertial means permitting said tether line to be withdrawn at a speed permitting normal movement by said occupant about said boat and locking in response to sudden more rapid movement to prevent further withdrawal of said line, said means securing the free end of said tethering line to said boat occupant comprising inflatable flotation means worn by said occupant, said flotation means comprising a harness including a waist encircling belt, said tethering line being releasably connected to said belt, a pair of shoulder straps secured at the front and rear to said belt and adapted to extend over the shoulders of said occupant, at least one normally deflated flotation bag carried by each said shoulder strap, a pouch carried by each said shoulder strap within which said normally deflated flotation bags are stowed, compressed gas container means, and means for releasing the compressed gas from said container means to inflate said flotation bags, said means for releasing the compressed gas comprising an emergency handle for activation by said occupant for simultaneously inflating said flotation bags and disconnecting said tethering line from said belt.

3. A safety device for a boat occupant, comprising a tethering line wound upon a self-retracting reel, means affixing said reel to the boat structure, means securing the free end of said tethering line to said boat occupant comprising a belt worn around the waist of said occupant and means connecting said line to said belt, said belt including flotation means comprising a normally deflated bay carried by said belt and a pouch affixed to said belt within which said normally deflated bag is stowed, said tethering line being releasably connected to said belt, compressed gas container means, and means for releasing the compressed gas from said container means to inflate said flotation bag, said means for releasing the compressed gas comprising an emergency handle adapted to be activated by said occupant for simultaneously inflating said flotation bag and disconnecting said tethering line from said belt.

4. A safety device for a boat occupant, comprising a tethering line wound upon a self-retracting reel, means affixing said reel to the boat structure, means securing the free end of said tethering line to said boat occupant including inflatable flotation means worn by said occupant, said flotation means comprising a harness including a waist encircling belt, said tethering line being releasably connected to said belt, a pair of shoulder straps secured at the front and rear to said belt and adapted to extend over the shoulders of said occupant, at least one normally deflated flotation bag carried by each said shoulder strap, a pouch carried by each said shoulder strap within which said normally deflated flotation bag is stowed, compressed gas container means, and means for releasing the compressed gas from said container means to inflate said flotation bags, said means for releasing the compressed gas comprising an emergency handle adapted to be activated by said occupant for simultaneously inflating said flotation bags and disconnecting said tethering line from said belt.

* * * * *